US010177489B1

(12) United States Patent
Aoshima

(10) Patent No.: US 10,177,489 B1
(45) Date of Patent: Jan. 8, 2019

(54) CONNECTOR DEVICE

(71) Applicant: Yazaki Corporation, Tokyo (JP)

(72) Inventor: Kengo Aoshima, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/005,560

(22) Filed: Jun. 11, 2018

(30) Foreign Application Priority Data

Jun. 14, 2017 (JP) ..... 2017-116552

(51) Int. Cl.

| | |
|---|---|
| ***H01R 13/648*** | (2006.01) |
| ***H01R 13/533*** | (2006.01) |
| ***H01R 13/11*** | (2006.01) |
| ***H01R 13/631*** | (2006.01) |
| *H01R 13/193* | (2006.01) |

(52) U.S. Cl.
CPC ..... *H01R 13/533* (2013.01); *H01R 13/113* (2013.01); *H01R 13/631* (2013.01); *H01R 13/193* (2013.01); *H01R 2201/26* (2013.01)

(58) Field of Classification Search
None
See application file for complete search history.

(56) References Cited

U.S. PATENT DOCUMENTS

| | | | | |
|---|---|---|---|---|
| 7,402,087 | B2 * | 7/2008 | Wang | H01R 13/113 439/382 |
| 7,641,492 | B2 * | 1/2010 | Azuma | H01R 13/6272 439/271 |
| 2015/0207242 | A1 | 7/2015 | Sugiyama et al. | |
| 2016/0072222 | A1 * | 3/2016 | Hasegawa | H01H 50/048 439/382 |

FOREIGN PATENT DOCUMENTS

JP 2014-075217 A 4/2014

* cited by examiner

*Primary Examiner* — Tho D Ta
(74) *Attorney, Agent, or Firm* — Kenealy Vaidya LLP

(57) ABSTRACT

A connector device includes: a first connector having a first terminal provided in a connector fitting chamber; and a second connector having a second terminal that is accommodated in a connector fitting portion to be fitted to the connector fitting chamber and has a terminal receiving portion to which the first terminal is inserted when fitting the connector fitting portion to the connector fitting chamber. The terminal receiving portion is accommodated in the connector fitting portion with a gap. The connector fitting portion is provided with slits on an upper surface and a lower surface positioned with the terminal receiving portion interposed therebetween.

7 Claims, 6 Drawing Sheets

CONNECTOR DEVICE

CROSS-REFERENCE TO RELATED APPLICATION(S)

The present application claims priority to and incorporates by reference the entire contents of Japanese Patent Application No. 2017-116552 filed in Japan on Jun. 14, 2017.

BACKGROUND OF THE INVENTION

1. Field of the Invention

The present invention relates to a connector device in which a first connector and a second connector are fitted and connected.

2. Description of the Related Art

Conventionally, a connector device, which includes a first connector that has a first housing having a concave portion with an opening on one side thereof and a first terminal (male terminal) provided in a concave portion of the first housing, and a second connector that has a second housing having a convex portion to be fitted to the concave portion and a second terminal (female terminal) accommodated in the convex portion of the second housing, has been known (for example, see Japanese Patent Application Laid-open No. 2014-75217). This type of connector device is mounted on, for example, a vehicle such as a hybrid car and an electric automobile, and the first terminal is inserted into and electrically connected to the second terminal when the convex portion of the second housing is fitted to the concave portion of the first housing.

Meanwhile, it is required to secure contact reliability between the first terminal and the second terminal even under vibrating environment in the above-described connector device. Thus, it is assumed a configuration in which a clearance (gap) between the convex portion of the second housing and the second terminal accommodated in the convex portion is formed at minimum, and movement of the second terminal inside the second housing is suppressed to prevent a part where the first terminal and the second terminal contact each other from being affected by vibration.

However, when the clearance between the second housing and the second terminal is formed at minimum, it is difficult to absorb a positional deviation (positional tolerance) of the first terminal with respect to the concave portion of the first housing using the above-described clearance at the time of fitting the first housing and the second housing to each other. Thus, the contact between the first terminal and the second terminal deviates, and there occurs a problem that a fitting resistance between the first connector and the second connector increases.

SUMMARY OF THE INVENTION

The present invention has been made in view of the above description, and an object thereof is to provide a connector device capable of improving contact reliability between a first terminal and a second terminal while suppressing an increase in fitting resistance between a first connector and a second connector.

A connector device according to one aspect of the present invention includes a first connector that includes a first housing having a concave portion with an opening on one side thereof, and a first terminal provided in the first housing and protruding from a bottom of the concave portion toward the opening; and a second connector that includes a second housing having a convex portion to be fitted to the concave portion, and a second terminal accommodated in the convex portion of the second housing and having a terminal receiving portion to which the first terminal is inserted and electrically connected when the convex portion is fitted to the concave portion, wherein the terminal receiving portion is accommodated inside the convex portion with a predetermined gap, slits, cut out until the terminal receiving portion is exposed, are provided, respectively, on surfaces, positioned with the terminal receiving portion interposed therebetween, of the convex portion of the second housing, and the first housing includes ribs extending from inner surfaces, which oppose to each other, of the concave portion toward the respective opposing surfaces and clamp the terminal receiving portion through the slits when the convex portion and the concave portion are fitted to each other.

According to this configuration, since the terminal receiving portion of the second terminal, to be accommodated in the convex portion of the second housing, is clamped by the ribs provided in the concave portion of the first housing through the slit when the concave portion of the first housing and the convex portion of the second housing are fitted to each other, the movement of the terminal receiving portion with respect to the first terminal is restricted, and it is possible to improve the contact reliability between the first terminal and the second terminal. In addition, since the terminal receiving portion of the second terminal is accommodated inside the convex portion with the predetermined gap, the terminal receiving portion moves inside the convex portion before the ribs clamp the terminal receiving portion so that it is possible to easily connect the second terminal and the first terminal, and to suppress the increase in the fitting resistance between the first connector and the second connector.

According to another aspect of the present invention, in the connector device, it is preferable that the predetermined gap is set to a gap having a size that absorbs a positional tolerance of the first terminal provided in the first housing. According to this configuration, since the positional tolerance of the first terminal is absorbed by the gap, it is possible to easily connect the second terminal and the first terminal and to suppress the increase in the fitting resistance between the first connector and the second connector.

According to still another aspect of the present invention, the terminal receiving portion of the second terminal may include an indent portion contacting the first terminal and a spring portion biasing the indent portion in a direction of pressing the first terminal, and the ribs may start to be engaged with the terminal receiving portion after the contact between the first terminal and the indent portion and cover at least a contact portion between the first terminal and the indent portion to clamp the terminal receiving portion when the convex portion and the concave portion are fitted to each other. According to this configuration, since the ribs start to be engaged with the terminal receiving portion after contact between the first terminal and the indent portion, it is possible to easily connect the indent portion of the second terminal and the first terminal. In addition, when the fitting between the convex portion and the concave portion is completed, the ribs cover at least a contact portion between the first terminal and the indent portion and clamp the terminal receiving portion, and thus, the ribs suppress the movement or shaking of the second terminal accompanying vibration, so that it is possible to secure the contact reliability between the first terminal and the second terminal.

According to still another aspect of the present invention, the first terminal may be a flat plate-shaped tab terminal, and the plurality of ribs and slits may be provided in parallel across a width direction of the tab terminal. According to this configuration, since the tab terminal having the flat plate shape and the second terminal are clamped by the plurality of ribs provided in parallel, it is possible to cause the tab terminal and the second terminal to evenly contact each other.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, an embodiment according to the present invention will be described in detail with reference to the drawings. Incidentally, the invention is not limited by this embodiment. In addition, constituent elements in the embodiment include one that can be replaced by a person skilled in the art or substantially the same one. In addition, the vertical direction in the figure will be expressed as "upper" and "lower" in the present embodiment.

Figure 1:
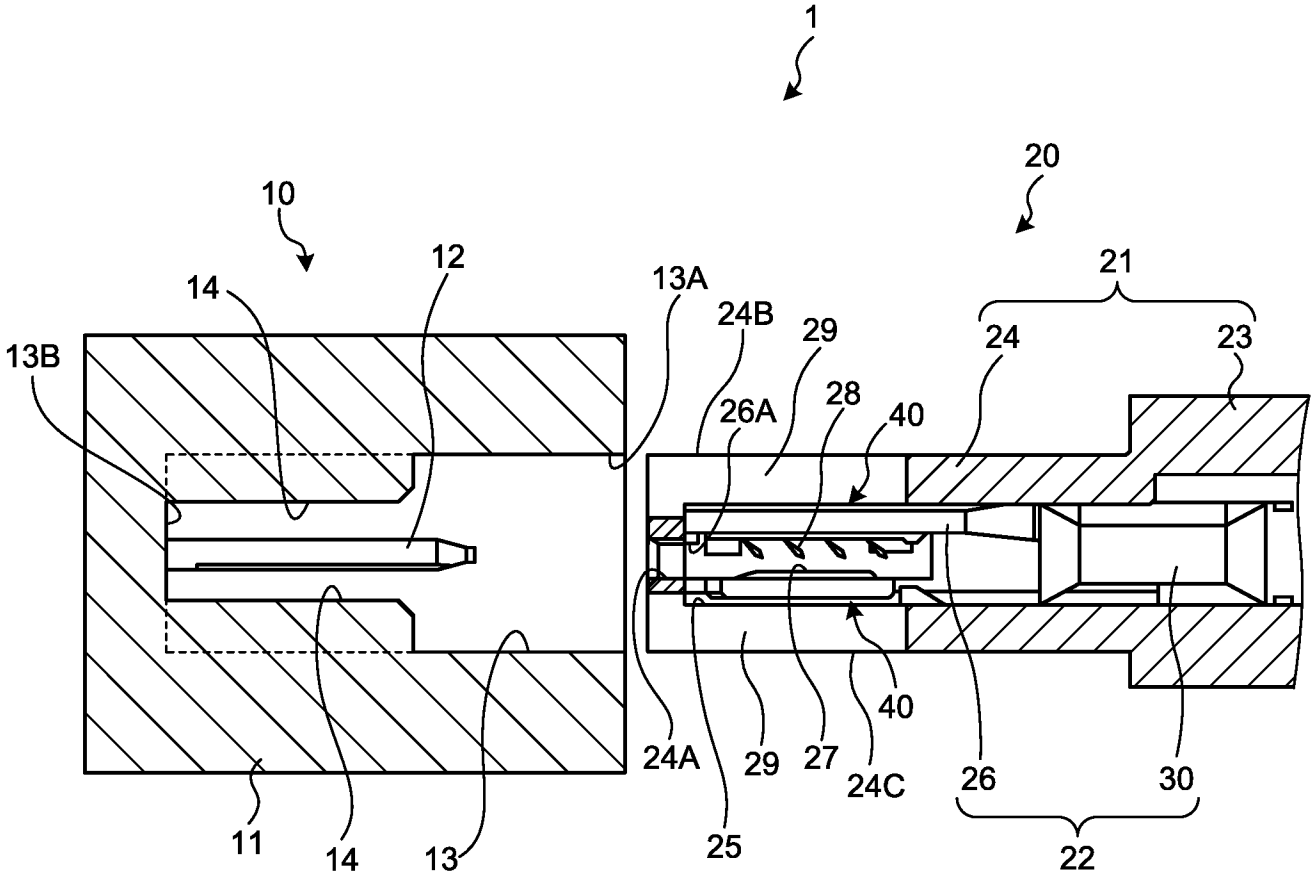
FIG. 1 is a cross-sectional view illustrating a state where fitting connection between a first connector and a second connector provided in a connector device according to the present embodiment is released.
Figure 2:
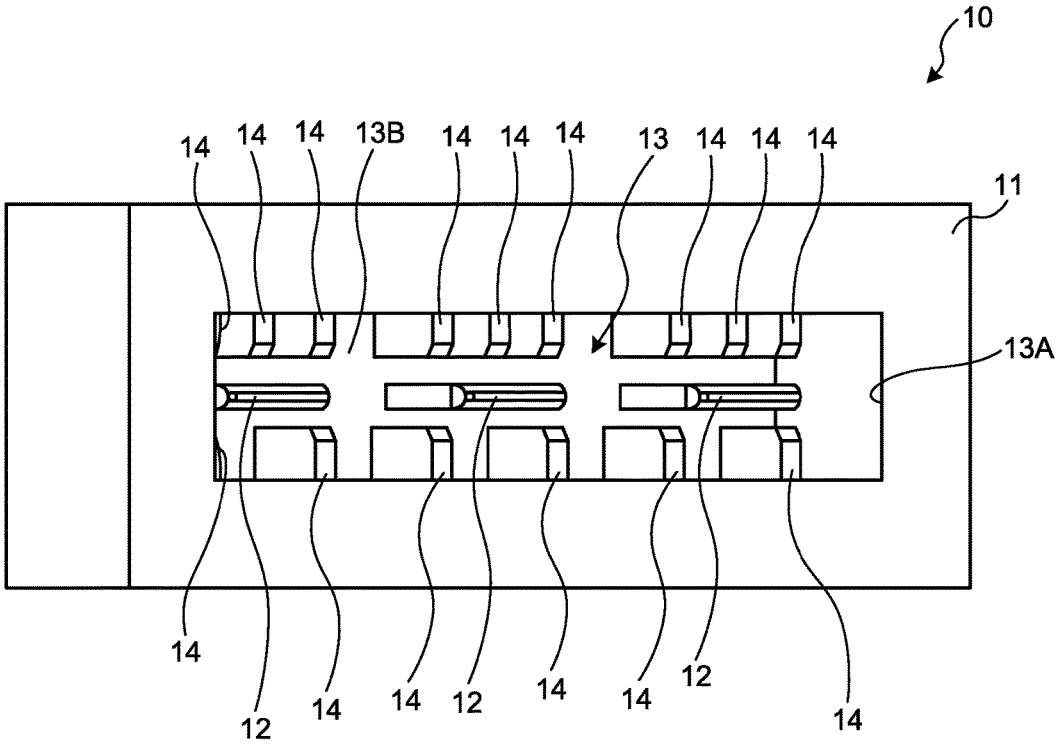
FIG. 2 is a perspective view illustrating the first connector.
Figure 3:
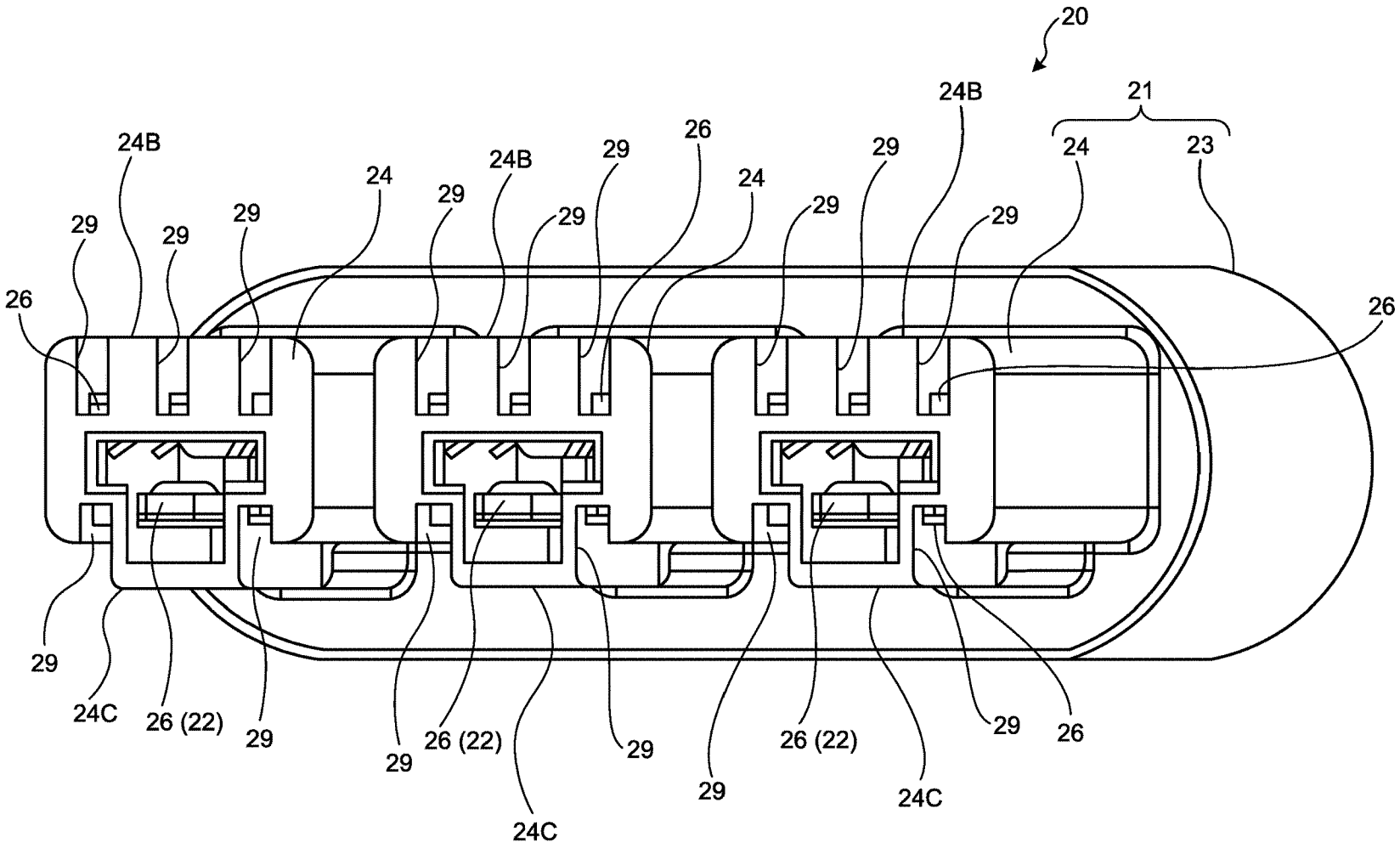
FIG. 3 is a perspective view illustrating the second connector.

FIG. 1 is a cross-sectional view illustrating a state where fitting connection between a first connector and a second connector provided in a connector device according to the present embodiment is released. FIG. 2 is a perspective view illustrating the first connector, and FIG. 3 is a perspective view illustrating the second connector. The connector device according to the present embodiment is mounted on, for example, a vehicle such as an electric automobile and a hybrid car, and is used for coupling of a high-voltage power cable that transmits a large amount of electric power between devices such as between a motor and an inverter or between an inverter and a battery.

As illustrated in FIG. 1, a connector device 1 includes a first connector 10 and a second connector 20 fitted to the first connector 10. As illustrated in FIGS. 1 and 2, the first connector 10 includes a first housing 11 and a first terminal (also referred to as a male terminal) 12 provided in the first housing 11. The first housing 11 is formed in a horizontally-elongated rectangular shape using a resin material having an insulating property, and a connector fitting chamber (concave portion) 13 having an opening 13A on one side thereof is formed inside the first housing 11. The first terminal 12 is provided to protrude toward the opening 13A from a back wall (bottom) 13B of the connector fitting chamber (concave portion) 13. The first terminal 12 is a so-called tab terminal obtained by forming a conductive metal material in a flat plate shape. In the present embodiment, the three first terminals 12 are arranged side by side in a width direction of the connector fitting chamber 13. Cables (not illustrated) are coupled with the first terminals 12, respectively.

A plurality of ribs 14, which extend from an upper surface and a lower surface (inner surfaces opposing to each other) of the connector fitting chamber 13 with the first terminal 12 interposed therebetween in the vertical direction toward the respective opposing surfaces, are integrally provided in the first housing 11. The plurality of ribs 14 are provided for each of the first terminals 12, and the plurality of ribs 14 are provided in parallel in the width direction of the first terminals 12. In the present embodiment, with respect to the one first terminal 12, the three ribs 14 extend from the upper surface of the connector fitting chamber 13 downward toward the first terminal 12, and the two ribs 14 extend from the lower surface thereof upward toward the first terminal 12. A distal end of the first terminal 12 is positioned to be closer to the opening 13A than these ribs 14 and contacts the second connector 20 before the rib 14. The number and positions of the ribs 14 are not limited to the example of the present embodiment, and can be appropriately changed depending on a size of the first terminal 12.

As illustrated in FIGS. 1 and 3, the second connector 20 includes a second housing 21 and a second terminal (also referred to as a female terminal) 22 provided in the second housing 21. The second housing 21 is formed using a resin material having an insulating property, and includes a main body portion 23 having a horizontally-elongated elliptical column shape, and three connector fitting portions (convex portions) 24 protruding from the main body portion 23 and fitted to the connector fitting chamber 13 of the first connector 10. Each of the connector fitting portions 24 is formed to have a shape and a size so as to be fit to the connector fitting chamber 13. A terminal accommodating chamber 25 is formed in the connector fitting portion 24 and the main body portion 23, and the second terminal 22 is accommodated in the terminal accommodating chamber 25.

The second terminal 22 is a terminal metal fitting that is molded into a desired shape by hammering, bending, or the like after punching a conductive metal plate material into a predetermined shape. The second terminal 22 includes a terminal receiving portion 26 configured such that the first terminal 12 can be inserted therein, and a connecting portion 30 to which a cable (not illustrated) is caulked.

The terminal receiving portion 26 is formed in a square tubular shape having an opening 26A in an insertion direction of the first terminal 12, and the opening 26A is formed in a wide rectangular shape in conformity with the shape of the first terminal 12 such that the first terminal 12 can be inserted therethrough. In addition, the terminal receiving portion 26 includes an indent portion 27 contacting the first terminal 12 inserted through the opening 26A and a spring portion 28 that presses and biases the first terminal 12 toward the indent portion 27. The spring portion 28 is formed by bending a metal plate, and a plurality of the spring portions 28 are formed along the insertion direction of the first terminal 12. As a result, the plurality of spring portions 28 press and bias the first terminal 12 toward the indent portion 27, so that it is possible to cause the first terminal 12 to uniformly contact the indent portion 27 (the second terminal 22).

As described above, the second terminal 22 is accommodated in the terminal accommodating chamber 25 formed in the second housing 21. In the present embodiment, the terminal receiving portion 26 of the second terminal 22 is arranged such that a gap 40 having a predetermined size is provided between the terminal receiving portion 26 and each of inner surfaces (particularly an upper surface and a lower surface) of the terminal accommodating chamber 25. The terminal receiving portion 26 is configured to be movable in the vertical direction within a range of the size of the gap 40. The size of the gap 40 is set to be equal to a positional tolerance (positional deviation) of the first terminal 12 provided in the connector fitting chamber 13 of the first housing 11 or larger than the positional tolerance, and it is possible to absorb the positional tolerance of the first terminal 12 as the terminal receiving portion 26 moves inside the terminal accommodating chamber 25. In addition, the second housing 21 has an insertion opening 24A formed at a distal end of the connector fitting portion 24, and the insertion opening 24A communicates with the opening 26A of the terminal receiving portion 26 to be accommodated in the terminal accommodating chamber 25.

In addition, slits 29 are provided in the connector fitting portion 24 of the second housing 21 on each of an upper surface 24B and a lower surface 24C which are positioned with the terminal receiving portion 26 interposed therebetween. The slit 29 is formed at a position corresponding to the rib 14 of the first housing 11, and the three slits 29 are provided on the upper surface 24B of the connector fitting portion 24 toward the terminal receiving portion 26, and the two slits 29 are provided on the lower surface 24C of the connector fitting portion 24 toward the terminal receiving portion 26. All the slits 29 are formed to be cut out until the terminal receiving portion 26 is exposed, and the ribs 14 entering the slits 29 vertically clamp the terminal receiving portions 26.

Figure 4:
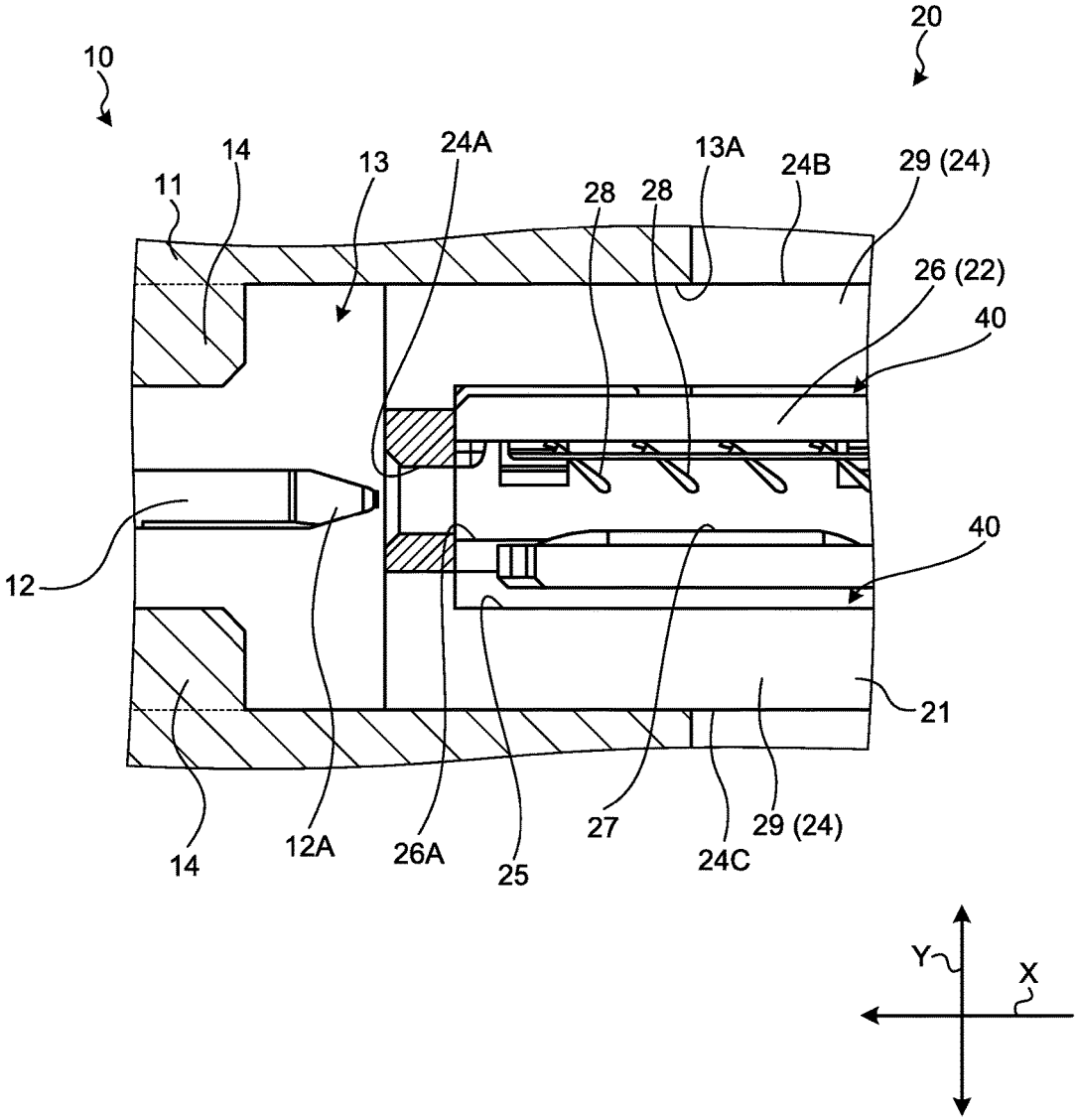
FIG. 4 is a partially enlarged cross-sectional view illustrating a state before a first terminal of the first connector and a second terminal of the second connector are connected to each other.
Figure 5:
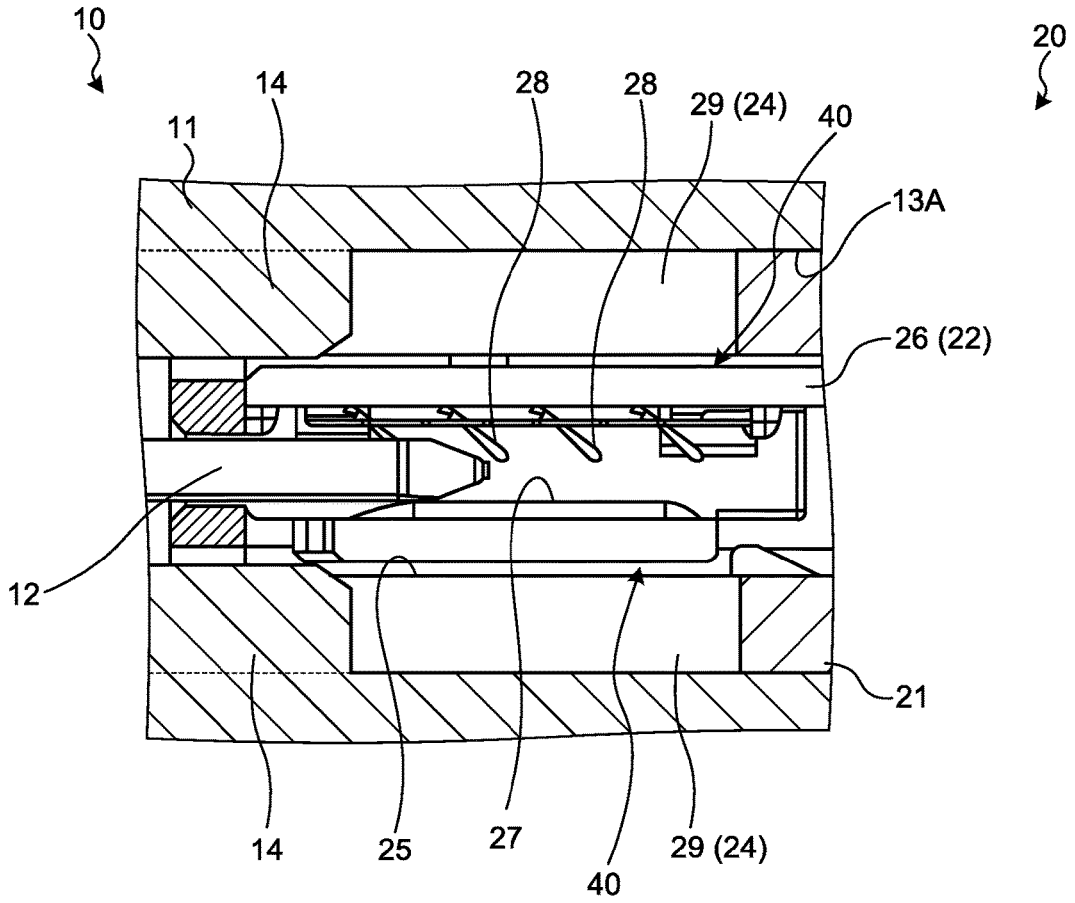
FIG. 5 is a partially enlarged cross-sectional view illustrating a state where the first terminal is inserted into the second terminal.
Figure 6:
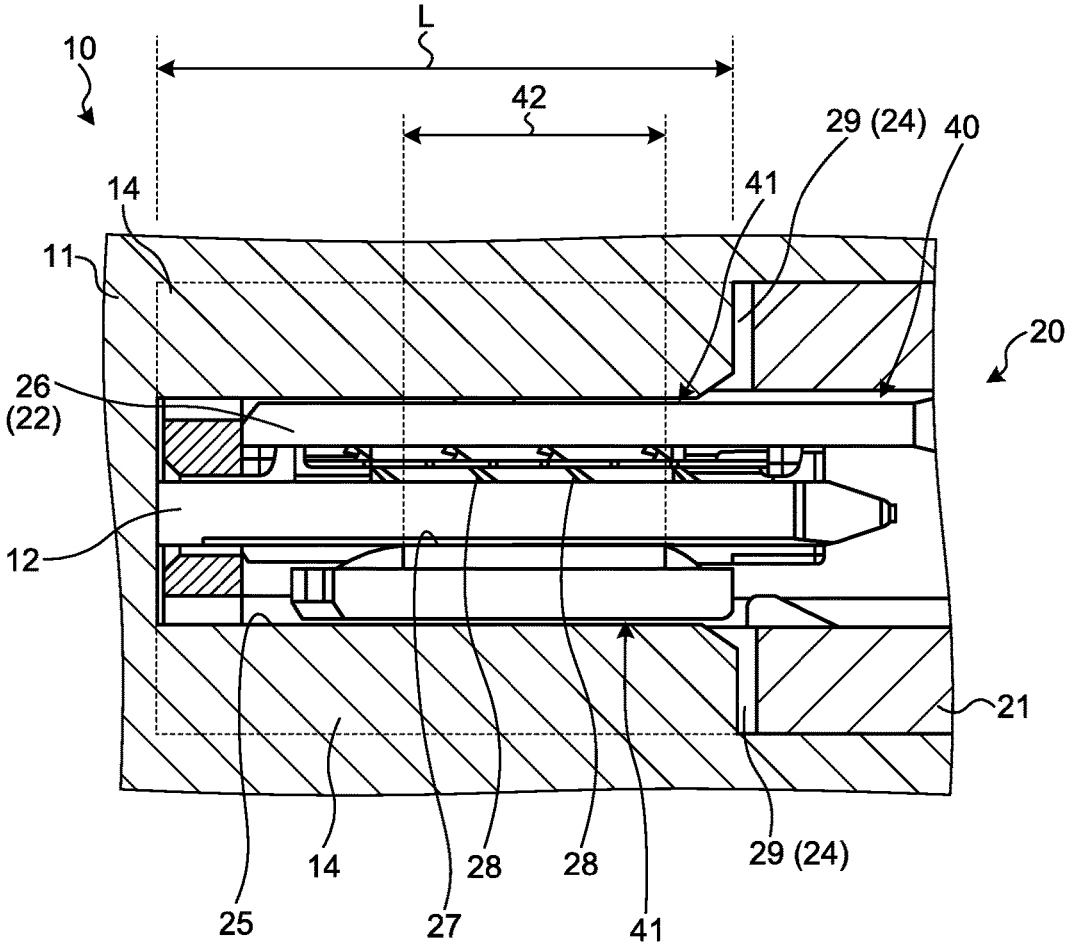
FIG. 6 is a partially enlarged cross-sectional view illustrating a state where connection between the first terminal and the second terminal is completed.

Next, a fitting operation between the first connector 10 and the second connector 20 will be described. FIG. 4 is a partially enlarged cross-sectional view illustrating a state before the first terminal of the first connector and the second terminal of the second connector are connected to each other. FIG. 5 is a partially enlarged cross-sectional view illustrating a state where the first terminal is inserted into the second terminal. FIG. 6 is a partially enlarged cross-sectional view illustrating a state where connection between the first terminal and the second terminal is completed.

First, as illustrated in FIG. 4, the connector fitting portion 24 of the second connector 20 is inserted into the connector fitting chamber 13 of the first connector 10 along the insertion direction (the X direction in the drawing). The connector fitting portion 24 is formed to have the shape and size to be fitted into the connector fitting chamber 13. Thus, each of the upper surface 24B and the lower surface 24C of the connector fitting portion 24 is guided by the inner surface of the connector fitting chamber 13 and inserted into the connector fitting chamber 13. In addition, a distal end 12A of the first terminal 12 is positioned to be closer to the opening 13A side of the connector fitting chamber 13 than the rib 14. Thus, as the connector fitting portion 24 is inserted into the connector fitting chamber 13, the distal end 12A of the first terminal 12 is inserted into the terminal receiving portion 26 to be accommodated in the terminal accommodating chamber 25 of the connector fitting portion 24 through the insertion opening 24A and the opening 26A.

In the present embodiment, the terminal receiving portion 26 is arranged such that the predetermined gap 40 is provided between the terminal receiving portion 26 and each of the upper surface and the lower surface of the terminal accommodating chamber 25, and the terminal receiving portion 26 is configured to be movable in the vertical direction within the range of the size of the gap 40. In addition, the size of the gap 40 is set to be equal to the positional tolerance of the first terminal 12 provided in the connector fitting chamber 13 of the first housing 11 or larger than the positional tolerance. Thus, when the first terminal 12 is inserted into the terminal receiving portion 26, it is possible to absorb the positional tolerance of the first terminal 12 by moving the terminal receiving portion 26 vertically (in the Y direction in the drawing) inside the terminal accommodating chamber 25. Therefore, it is possible to suppress deviation of the contact of the first terminal 12 with respect to the terminal receiving portion 26 (the second terminal 22), and thus, it is possible to suppress an increase in fitting resistance between the first connector 10 and the second connector 20.

Subsequently, when the connector fitting portion 24 of the second connector 20 is further inserted into the connector fitting chamber 13 of the first connector 10 as illustrated in FIG. 5, the first terminal 12 contacts the indent portion 27 and the spring portion 28 of the terminal receiving portion 26, the first terminal 12 is pressed against the indent portion 27 by a biasing force of the spring portion 28, and the first terminal 12 and the indent portion 27 (the second terminal 22) start to contact each other. Here, the upper and lower ribs 14 are formed so as to be engaged with the terminal receiving portion 26 through the slit 29 after the first terminal 12 and the indent portion 27 contact each other. As a result, the rib 14 does not hinder the contact between the first terminal 12 and the indent portion 27, and thus, it is possible to easily connect the first terminal 12 and the indent portion 27.

In addition, the upper and lower ribs 14 are engaged with the terminal receiving portions 26 to clamp the terminal receiving portions 26 as illustrated in FIG. 6. In this case, a gap in the vertical direction between the upper and lower ribs 14 is set to be shorter than a length of the terminal accommodating chamber 25 in the vertical direction, and further, each gap 41 in the vertical direction between each of the upper and lower ribs 14 and the terminal receiving portion 26 is set to be smaller than the gap 40 in the vertical direction between the terminal accommodating chamber 25 and the terminal receiving portion 26. Thus, the movement of the terminal receiving portion 26 (the second terminal 22) inside the terminal accommodating chamber 25 is restricted by the upper and lower ribs 14.

In addition, the upper and lower ribs 14 have a length L (a length in a fitting direction) so as to cover a contact portion 42 between the first terminal 12 and the indent portion 27 in the present embodiment. Thus, when the fitting between the connector fitting portion 24 of the second connector 20 and the connector fitting chamber 13 of the first connector 10 is completed, the upper and lower ribs 14 can cover the contact portion 42 between the first terminal 12 and the indent portion 27 and clamp the terminal receiving portion 26. Therefore, it is possible to suppress the movement or shaking of the terminal receiving portion 26 (the second terminal 22) accompanying vibration of the vehicle, and thus, it is possible to maintain the contact reliability between the first terminal 12 and the second terminal 22.

As described above, the connector device 1 according to the present embodiment includes: the first connector 10 that has the first housing 11 having the connector fitting chamber 13 with an opening on one side thereof and the first terminal 12 provided in the first housing 11 and protruding from the back wall 13B of the connector fitting chamber 13 toward the opening 13A; and the second connector 20 that has the second housing 21 having the connector fitting portion 24 to be fitted to the connector fitting chamber 13, and the second terminal 22 accommodated in the connector fitting portion 24 of the second housing 21 and having the terminal receiving portion 26 to which the first terminal 12 is inserted and electrically connected when the connector fitting portion 24 is fitted to the connector fitting chamber 13. The terminal receiving portion 26 is accommodated inside the terminal accommodating chamber 25 of the connector fitting portion 24 with the predetermined gap 40. The connector fitting portion 24 of the second housing 21 is provided with the slits 29, cut out until the terminal receiving portion 26 is exposed, on the upper surface 24B and the lower surface 24C positioned with the terminal receiving portion 26 interposed therebetween. The first housing 11 includes the ribs 14 extending from the upper surface and the lower surface of the connector fitting chamber 13 toward the respective opposing surfaces and vertically clamp the terminal receiving portion 26 through the slits 29 when the connector fitting portion 24 and the connector fitting chamber 13 are fitted to each other.

According to this configuration, when the connector fitting chamber 13 of the first housing 11 and the connector fitting portion 24 of the second housing 21 are fitted to each other, the terminal receiving portion 26 of the second terminal 22 to be accommodated in the terminal accommodating chamber 25 is clamped by the upper and lower ribs 14 provided in the connector fitting chamber 13 of the first housing 11 through the slit 29 in the connector fitting portion 24, and thus, the movement of the terminal receiving portion 26 with respect to the first terminal 12 is restricted, and it is possible to improve the contact reliability between the first terminal 12 and the second terminal 22. In addition, since the terminal receiving portion 26 of the second terminal 22 is accommodated inside the terminal accommodating chamber 25 of the connector fitting portion 24 with the predetermined gap 40, the terminal receiving portion 26 moves inside the terminal accommodating chamber 25 before the upper and lower ribs 14 clamp the terminal receiving portion 26, so that it is possible to easily connect the second terminal 22 and the first terminal 12 and to suppress the increase in the fitting resistance between the first connector 10 and the second connector 20.

In addition, according to the present embodiment, since the predetermined gap 40 is set to the size that absorbs the positional tolerance of the first terminal 12 provided in the connector fitting chamber 13 of the first housing 11, it is possible to easily connect the second terminal 22 and the first terminal 12 and to suppress the increase in the fitting resistance between the first connector 10 and the second connector 20.

In addition, according to the present embodiment, since the terminal receiving portion 26 of the second terminal 22 includes the indent portion 27 contacting the first terminal 12 and the spring portion 28 biasing the indent portion 27 in the direction of pressing the first terminal 12, and the rib 14 starts to be engaged with the terminal receiving portion 26 after the contact between the first terminal 12 and the indent portion 27, it is possible to prevent the rib 14 from hindering the contact between the first terminal 12 and the indent portion 27. Thus, it is possible to easily perform the connection the first terminal 12 and the indent portion 27. Further, the ribs 14 covers the contact portion 42 between the first terminal 12 and the indent portion 27 and clamp at least the terminal receiving portion 26 when the connector fitting portion 24 and the connector fitting chamber 13 are fitted to each other. Thus, it is possible to suppress the movement or shaking of the terminal receiving portion 26 (the second terminal 22) accompanying the vibration of the vehicle, for example, so that it is possible to maintain the contact reliability between the first terminal 12 and the second terminal 22.

In addition, according to the present embodiment, since the first terminal 12 is the flat plate-shaped tab terminal and the plurality of ribs 14 and slits 29 are provided in parallel across the width direction of the tab terminal, the flat plate-shaped tab terminal and the terminal receiving portion 26 are clamped by the plurality of ribs 14 provided in parallel so that it is possible to cause the tab terminal and the indent portion 27 of the terminal receiving portion 26 to uniformly contact each other.

Although the embodiment of the present invention has been described as above, the present embodiment has been presented as an example, and is not intended to limit the scope of the invention. The present embodiment can be implemented in various other forms, and various omissions, replacements, and modifications can be made within a scope not departing from a gist of the invention. The present embodiment and its modifications are included in the invention described in the claims and the equivalent scope thereof as well as included in the scope and gist of the invention. For example, the above-described embodiment has been described regarding the configuration in which the first connector 10 and the second connector 20 are used for the connection of the high-voltage power cable to be connected to a three-phase AC motor or the like, and thus, have the three first terminals 12 and the three second terminals 22, respectively, but it is a matter of course that the number of terminals may be appropriately changed in accordance with the application.

In addition, the present embodiment has been described regarding the configuration in which the rib 14 and the slit 29 are provided on the upper surface and the lower surface of the first housing 11 and the second housing 21, respectively, but the rib 14 and the slit 29 may be provided in the horizontal direction orthogonal to the vertical direction as long as the rib 14 and the slit 29 are configured to clamp the terminal receiving portion 26 of the second terminal 22. In addition, the rib 14 and the slit 29 may be provided to correspond to each other not only vertically but also horizontally.

In addition, the connector device 1 is used for the connection of the high-voltage power cable that transmits a large amount of power between the devices such as between the motor and the inverter or between the inverter and the battery in the present embodiment, it is a matter of course that the invention can be also applied to a connector device to be used for another application.

According to the present embodiments, since the terminal receiving portion of the second terminal, to be accommodated in the convex portion of the second housing, is clamped by the ribs provided in the concave portion of the first housing through the slit when the concave portion of the first housing and the convex portion of the second housing are fitted to each other, the movement of the terminal receiving portion with respect to the first terminal is restricted, and it is possible to improve the contact reliability between the first terminal and the second terminal. In addition, since the terminal receiving portion of the second terminal is accommodated inside the convex portion with the predetermined gap, the terminal receiving portion moves inside the convex portion before the ribs clamp the terminal receiving portion so that it is possible to easily connect the second terminal and the first terminal, and to suppress the increase in the fitting resistance between the first connector and the second connector.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector device comprising:

a first connector that includes a first housing having a concave portion with an opening on one side thereof, and a first terminal provided in the first housing and protruding from a bottom of the concave portion toward the opening; and a second connector that includes a second housing having a convex portion to be fitted to the concave portion, and a second terminal accommodated in the convex portion of the second housing and having a terminal receiving portion to which the first terminal is inserted and electrically connected when the convex portion is fitted to the concave portion, wherein the terminal receiving portion is accommodated inside the convex portion with a predetermined gap, slits, cut out until the terminal receiving portion is exposed, are provided, respectively, on surfaces, positioned with the terminal receiving portion interposed therebetween, of the convex portion of the second housing, and the first housing includes ribs extending from inner surfaces, which oppose to each other, of the concave portion toward the respective opposing surfaces and clamp the terminal receiving portion through the slits when the convex portion and the concave portion are fitted to each other.

2. The connector device according to claim 1, wherein the predetermined gap is set to a gap having a size that absorbs a positional tolerance of the first terminal provided in the first housing.

3. The connector device according to claim 1, wherein the terminal receiving portion of the second terminal includes an indent portion contacting the first terminal and a spring portion biasing the indent portion in a direction of pressing the first terminal, and the ribs start to be engaged with the terminal receiving portion after the contact between the first terminal and the indent portion and cover at least a contact portion between the first terminal and the indent portion to clamp the terminal receiving portion when the convex portion and the concave portion are fitted to each other.

4. The connector device according to claim 2, wherein the terminal receiving portion of the second terminal includes an indent portion contacting the first terminal and a spring portion biasing the indent portion in a direction of pressing the first terminal, and the ribs start to be engaged with the terminal receiving portion after the contact between the first terminal and the indent portion and cover at least a contact portion between the first terminal and the indent portion to clamp the terminal receiving portion when the convex portion and the concave portion are fitted to each other.

5. The connector device according to claim 1, wherein the first terminal is a flat plate-shaped tab terminal, and the plurality of ribs and slits are provided in parallel across a width direction of the tab terminal.

6. The connector device according to claim 2, wherein the first terminal is a flat plate-shaped tab terminal, and the plurality of ribs and slits are provided in parallel across a width direction of the tab terminal.

7. The connector device according to claim 3, wherein the first terminal is a flat plate-shaped tab terminal, and the plurality of ribs and slits are provided in parallel across a width direction of the tab terminal.

* * * * *